US005346360A

United States Patent [19]

Cooper

[11] Patent Number: 5,346,360

[45] Date of Patent: Sep. 13, 1994

[54] APPARATUS AND METHODS FOR CONVERTING A STEAM TURBINE CONTROL SYSTEM FROM MECHANICAL/HYDRAULIC TO ELECTRICAL/HYDRAULIC CONTROL

[75] Inventor: Edward J. Cooper, Schenectady, N.Y.

[73] Assignee: General Electric Company, Schenectady, N.Y.

[21] Appl. No.: 101,305

[22] Filed: Aug. 3, 1993

[51] Int. Cl.[5] ..... F01D 17/06

[52] U.S. Cl. ..... 415/38

[58] Field of Search ..... 415/38

[56] References Cited

U.S. PATENT DOCUMENTS 3,026,889 3/1962 Bryant ..... 415/38

*Primary Examiner*—John T. Kwon

*Attorney, Agent, or Firm*—Nixon & Vanderhye

[57] ABSTRACT

In a steam turbine control system, the mechanical/hydraulic input to a mechanical control link within a servo enclosure controlling the steam supply valves to the turbine is replaced by an electrical/hydraulic control system while retaining all mechanical/hydraulic connections between the servo enclosure and the steam valves. A hydraulic cylinder is coupled to a control link in the servo enclosure which operates the steam valves. The cylinder is actuated by a servo control valve for modulating the flow of steam to the turbine. A fast trip valve forms part of the hydraulic fluid supply to the piston and is movable in response to a cutoff of hydraulic pressure fluid to the shut-off valve to shift and deadend the hydraulic fluid supply to the piston whereby, in response to a system upset, the shut-off valve instantaneously stops the supply of hydraulic fluid to the piston and thereby instantaneously actuates the steam valves to preclude flow of steam to the turbine.

5 Claims, 3 Drawing Sheets 30
32
34
PUMP SUPPLY
38
24
58
40
42
44
48
22
46
50
54
26
34
PUMP SUPPLY
52
SOLENOID VALVE
53
56

APPARATUS AND METHODS FOR CONVERTING A STEAM TURBINE CONTROL SYSTEM FROM MECHANICAL/HYDRAULIC TO ELECTRICAL/HYDRAULIC CONTROL

TECHNICAL FIELD

The present invention relates to steam turbine control systems and particularly relates to methods for converting mechanical/hydraulic control systems for modulating or instantaneously precluding the flow of steam through steam turbine control valves to electrical/hydraulic systems for performing the same function.

BACKGROUND

It is essential to control the supply of steam to steam turbines in accordance with operating conditions. For example, when the load on a turbine changes, it is necessary to modulate the flow of steam to the turbine. In the event the load on a generator is lost or if unacceptable vibrations or thrust loads occur, it is also necessary to quickly, virtually instantaneously, shut down the flow of steam to the turbine. Otherwise, the turbine will quickly obtain an overspeed condition. Steam supply valves are, of course, used to modulate and instantaneously stop the supply of steam to the turbine in response to changes in load on the turbine or a system upset requiring shutdown.

Electrical hydraulic control systems have been developed and provided on modern steam turbine units. However, there are a large number of steam turbines currently in the field operating with mechanical/hydraulic control systems. It has been found desirable to convert the older mechanical/hydraulic control (MHC) systems to the more modern electrical/hydraulic control (EHC) systems. MHC-to-EHC control conversions have been previously supplied on small industrial steam turbines. However, in such conversions, the EHC high pressure actuators were retrofitted and were controlled only by a servo valve which did not have an overriding fast closing capability. In mechanical/hydraulic control systems, there is typically provided an MHC servo enclosure in which a control link within the enclosure is operated by various mechanical devices providing input to the link within the enclosure. For example, mechanically operated speed control governors in MHC systems provide input to the control link within the servo enclosure to control the position of the link. The link, in turn, is coupled through various devices through a valve actuator lever which would actuate the valve to modulate or stop the flow of steam to the turbine.

Accordingly, it is desirable to eliminate the mechanical/hydraulic input to the control link and retrofit existing steam turbines having older MHC systems with EHC systems. While standard EHC valve actuators are available, they are difficult and costly to retrofit as replacements for existing MHC valve actuators. However, because it is also expensive to remove all of the mechanical and hydraulic linkage between the control link and the steam valve actuators, it has been found desirable to essentially replace the mechanical/hydraulic input to the control link in the servo enclosure with an electrical/hydraulic input and use the existing linkage between the control link and the valve actuators to modulate or stop the flow of steam through the steam valves to the turbine rather than replace the entire existing mechanical/hydraulic system.

DISCLOSURE OF THE INVENTION

Accordingly, in accordance with the present invention, the MHC linkage input between the link and the steam valve actuators is used but is under control of a small servo control high pressure cylinder. By disconnecting the mechanical/hydraulic control input to the link within the servo enclosure and coupling a servo control valve with a pilot operated fast trip valve, it has been found that an MHC-to-EHC conversion can be economically effected. This is particularly advantageous because the MHC valve actuators are controlled through extant mechanical and hydraulic linkage from the link within the servo enclosure but the link, in turn, can be controlled in a simple, straightforward manner by adding to the servo enclosure a servo controlled high pressure cylinder with an override trip.

To accomplish the foregoing, the prior MHC input to the link is disconnected. A high pressure cylinder is attached to the control link and biased to a position closing the steam valves to the turbines. A servo control valve receives electrical signals from the EHC control system and feedback from a linear voltage differential transducer to control the actuator piston stroke and, hence, the position of the existing link within the servo enclosure. Thus, the servo valve controls the supply of fluid to the high pressure cylinder to modulate the supply of steam to the turbine by controlling the existing link and mechanical/hydraulic interconnections between the link and the steam valve actuators. Additionally, to accommodate substantially instantaneous closing of the steam supply valves of the turbine in the event of a system upset, a pilot actuated valve coupled to the fluid supply to the cylinder is provided. Under normal operating conditions, the fluid supply to the high pressure cylinder maintains the pilot control valve in a position enabling supply of fluid through the servo control valve to the cylinder and, hence, the capability of modulating the steam flow to the turbine. Should a system upset occur, requiring immediate shut off of steam to the turbine, a fast trip signal is supplied from sensors in the system to a solenoid actuated valve in the pressure fluid supply to the pilot operated valve. By depressurizing the fluid supply to the pilot operated valve, the valve is shifted into a position dead-ending the fluid supply through the servo to the cylinder. Simultaneously, the high pressure cylinder is connected to the fluid drain. Thus, the cylinder is biased into a position moving the link to operate the valve actuators to close the steam supply to the turbine.

In a preferred embodiment according to the present invention, there is provided a steam turbine control system having mechanical or hydraulic input to a mechanical control link within a control valve servo enclosure and which link controls the output of the enclosure to an actuator of a steam valve for supplying steam to a turbine, a method of converting from a control system having the mechanical or hydraulic input to a control system having electrical/hydraulic input, comprising the steps of disconnecting the mechanical or hydraulic input to the mechanical control link, coupling a hydraulic actuator to the link, coupling an electrically controlled servo valve to control a supply of hydraulic fluid to the actuator to enable movement of the actuator to control the steam valve actuator to modulate steam flow to the turbine in response to movement of the actuator and coupling a shutoff valve in the hydraulic fluid supply to substantially instantaneously stop the supply of hydraulic fluid to the actuator in response to a system upset to enable the actuator to substantially instantaneously control the link to actuate the steam valve to preclude flow of steam to the turbine.

In a further preferred embodiment according to the present invention, there is provided a control system for a steam turbine comprising a control link for controlling an actuator for a valve for supplying steam to the turbine, a fluid actuated cylinder connected to the control link and biased for movement to a position wherein the control link controls the actuator to close the steam supply valve to the turbine, a fluid supply for supplying fluid to the cylinder, a servo control valve for controlling the supply of fluid to the cylinder and a shut-off valve movable into first and second positions normally enabling fluid from the fluid supply to flow through the servo control valve to the cylinder and preventing fluid from flowing from the fluid supply through the servo control valve to the cylinder, respectively. Means are provided for normally maintaining the shut-off valve in the first position to enable the servo control valve to modulate the flow of fluid to the cylinder and responsive to a steam turbine system upset for preventing fluid from flowing to the cylinder whereby, the cylinder being biased into the position to close the steam supply valve.

BEST MODE FOR CARRYING OUT THE INVENTION

Figure 1:
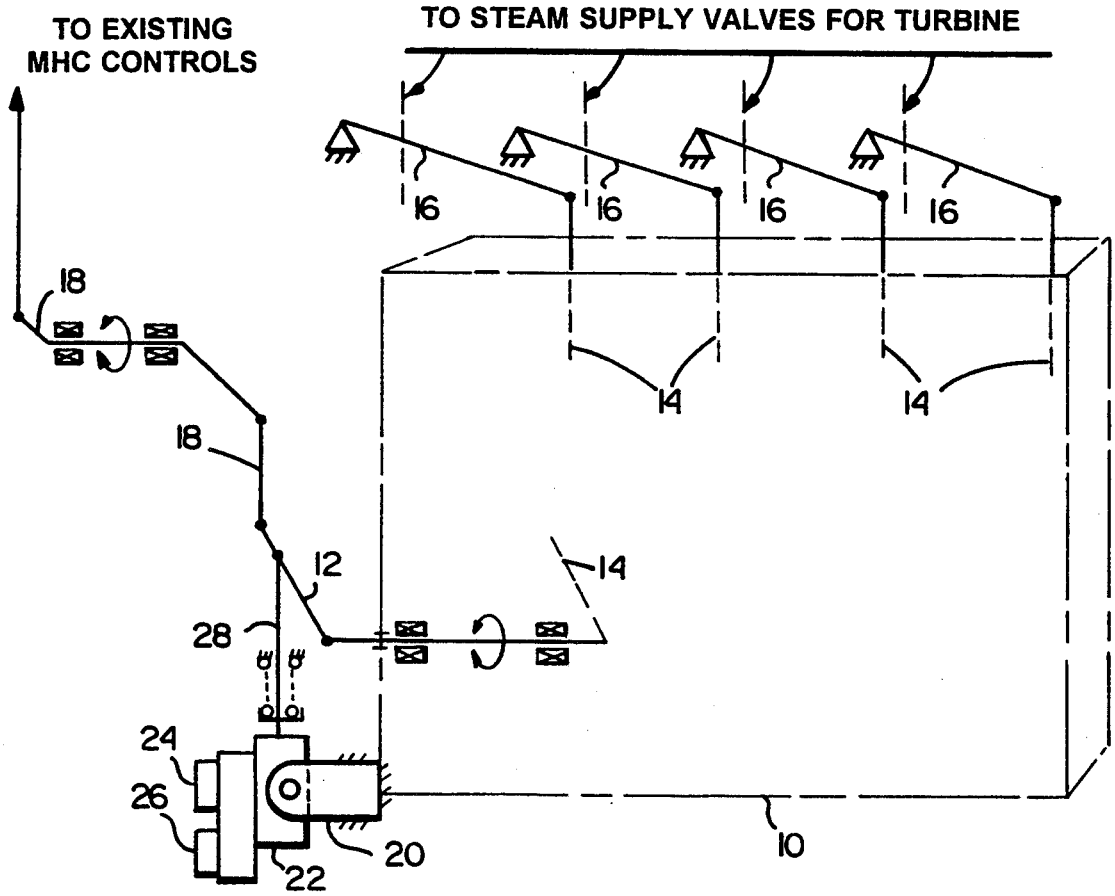
FIG. 1 is a schematic representation of an MHC servo enclosure illustrating a conversion to an EHC system according to the present invention.

Referring now to FIG. 1, there is illustrated an MHC servo enclosure, generally designated 10, having a control link 12 which, by various hydraulic and mechanical interconnections, not shown, and which are schematically illustrated by the dashed line 14, operates an actuator or valve lever 16 for controlling the steam supply valves to a turbine, also not shown. As illustrated in FIG. 1, the arrow 18 represents the standard MHC linkage connection on existing steam turbine units. Various mechanical and hydraulic linkages from external control systems, for example, those sensing system upsets which could lead to overspeed conditions, are coupled to linkage connection 18. The mechanical/hydraulic linkage to the control link 12 is replaced in accordance with the present invention by an electrical/hydraulic control (EHC) with the EHC system using the mechanical and hydraulic interconnections of line 14 to operate the steam valve actuator 16. Essentially, the mechanical/hydraulic control of link 12 in existing systems is replaced by an electrical/hydraulic control of link 12, the electrical/hydraulic control being coupled electrically to various sensors throughout the system.

Figure 2:
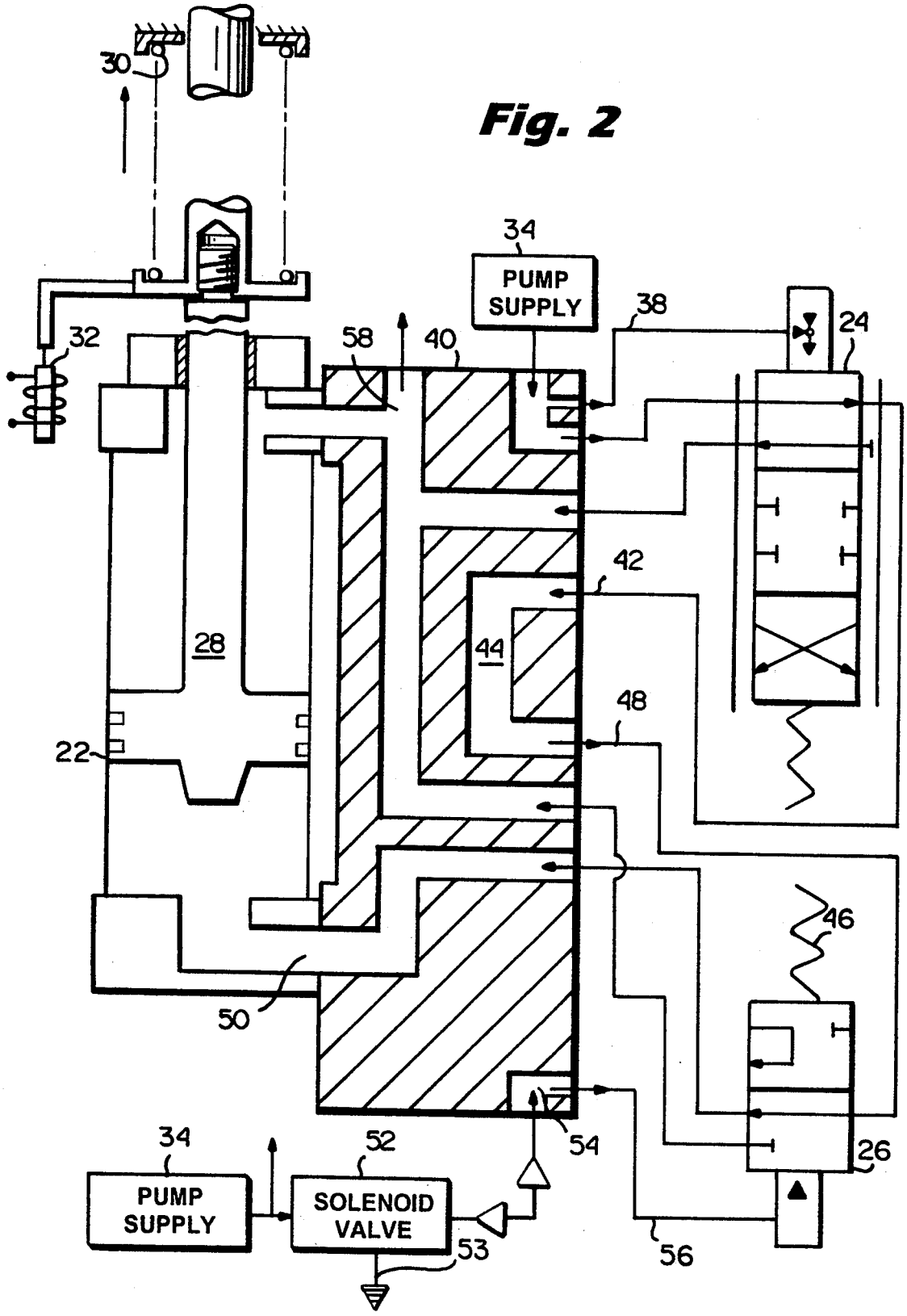
FIG. 2 is a schematic illustration with parts in cross-section and broken-out illustrating the servo controlled high pressure cylinder and pilot actuated valve of the present invention in a normal operating position enabling steam flow to the turbine.

To accomplish this, a bracket 20 is fixed to the MHC servo enclosure 10 and supports a high pressure fluid actuated cylinder 22 under control of a servo valve 24 and a pilot operated fast trip valve 26. Referring to FIG. 2, it will be seen that cylinder 22 includes a piston 28, the upper end of which is coupled to the control link 12. The piston 28 is biased by a spring 30 for movement into a position which also moves control link 12 to a position to close the steam supply valves to the turbine. The position of the piston 28 in cylinder 22 is sensed by a linear voltage differential transducer 32, the output of which is coupled to the servo valve 24, as described hereinafter. A source of fluid, preferably hydraulic fluid under pressure, is provided both servo valve 24 and pilot valve 26. The servo valve 24 is of conventional construction and has electrically actuated coils whereby an electrical input to the coils serves to deflect a fluid jet supply, indicated 38, which moves a secondary pilot in the servo valve to change the output pressure supplied to a fluid manifold 40 at 42. Thus, modulated fluid input from the pump supply passes into the manifold at 42 into a passageway 44.

Pressure fluid from the supply 34 is also supplied to pilot valve 26 to displace it against the bias of a spring 46 into a position enabling passage 48 in the pilot valve 26 to pass fluid from passageway 44 of manifold 40 through passage 48 and into passage 50 of the manifold into the cylinder 22 as illustrated in FIG. 2. Thus, when the high pressure fluid is supplied the pilot valve, electrical signals from the EHC control system and feedback from the linear voltage differential transducer 32 modulate the flow of fluid through passage 42 into the cylinder to accurately control the position of the cylinder and, hence, the position of link 12. As noted previously, the electrical signals to the servo valve thus control the position of piston 28 and link 12 to open or close the steam valves to a greater or lesser extent, as dictated by load conditions.

Figure 3:
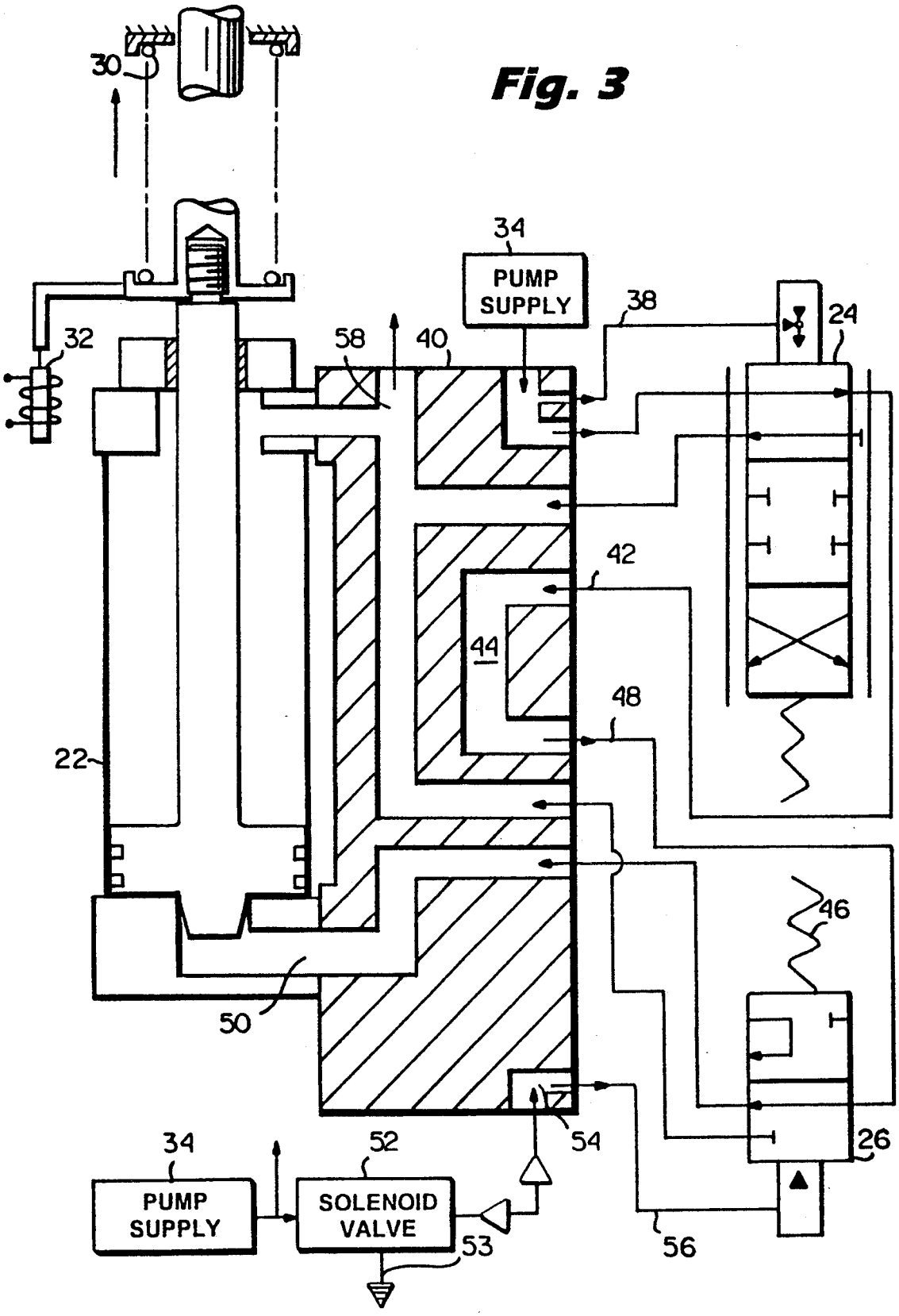
FIG. 3 is a view similar to FIG. 2 illustrating the conversion in a tripped condition.
Figure 3:
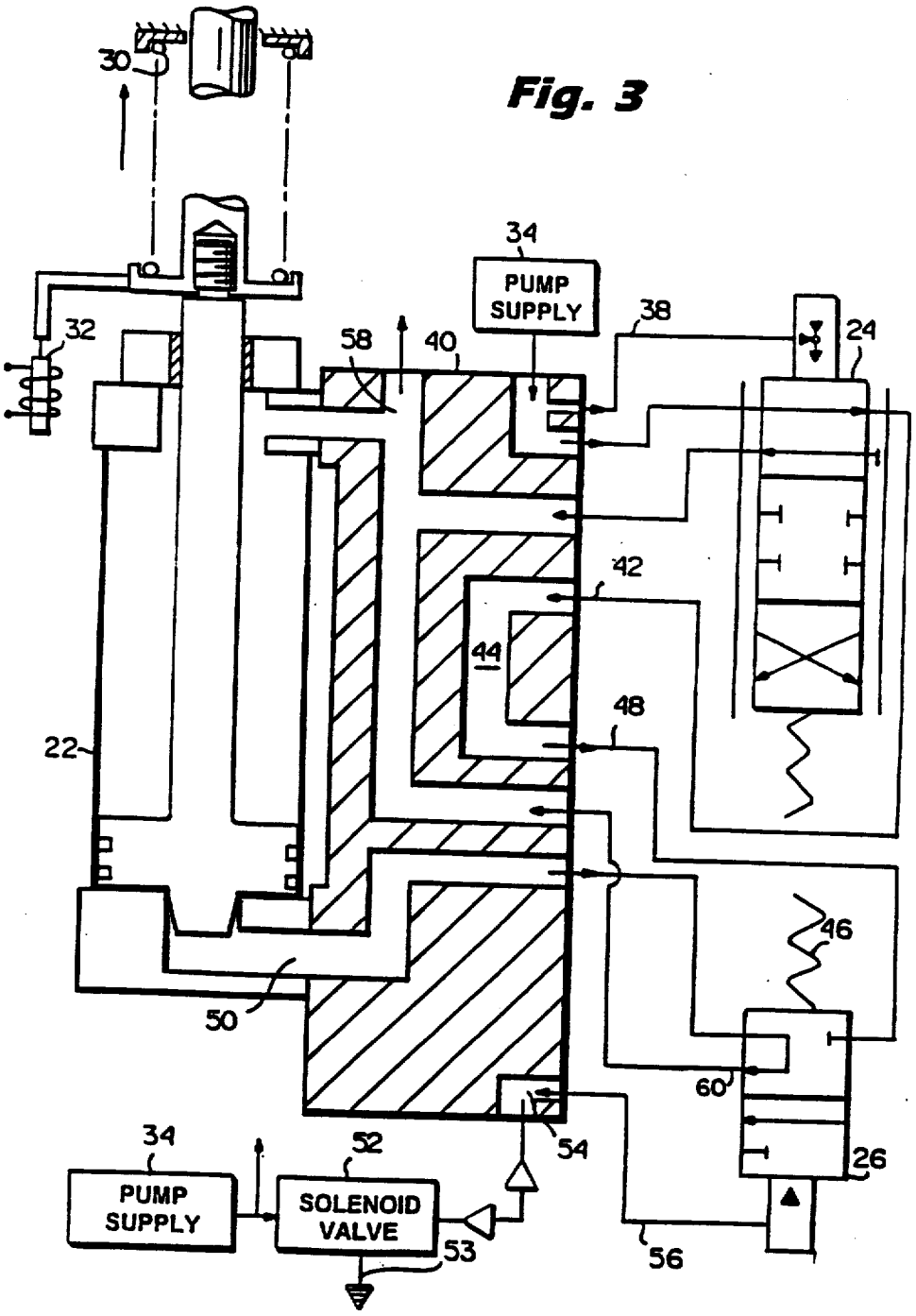

In the event of a system upset, and with reference to FIG. 3, an electrical control signal from the EHC control system, which senses a system upset, operates a solenoid valve 52 to close the supply of pressurized fluid to the manifold 40 and the pilot valve 26 by way of communicating passages 54 and 56. When those passages are depressurized, by way of drain 53 in solenoid valve 52, spring 46 biases the pilot valve 26 into the position illustrated in FIG. 3. In that position, passageway 44 in communication with the fluid supply through servo 24 is dead-ended. Additionally, the drain passages 58 through the manifold 40 are placed in communication via passage 50 and 60 in the pilot valve with the underside of piston 28 to enable the cylinder 22 to drain to a reservoir, not shown. Thus, the electrical control signal from the EHC control system substantially instantaneously causes the piston 28 to move the link into a position closing the steam supply through the steam supply valves.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. In a steam turbine control system having mechanical or hydraulic input to a mechanical control link within a control valve servo enclosure and which controls the output of said enclosure to an actuator of a steam valve for supplying steam to a turbine, a method of converting from a control system having the mechanical or hydraulic input to a control system having electrical/hydraulic input, comprising the steps of:

disconnecting the mechanical or hydraulic input to said mechanical control link;

coupling a hydraulic actuator to said link;

coupling an electrically controlled servo valve to control a supply of hydraulic fluid to said actuator to enable movement of the actuator to control the steam valve actuator to modulate steam flow to the turbine in response to movement of said actuator; and coupling a shut-off valve in said hydraulic fluid supply to substantially instantaneously stop the supply of hydraulic fluid to said actuator in response to a system upset to enable said actuator to substantially instantaneously control said link to actuate the steam valve to preclude flow of steam to said turbine.

2. A system according to claim 1 including the steps of biasing the shut-off valve for movement from a first position wherein it enables flow of hydraulic fluid to said actuator to modulate the steam flow into a second position to enable the actuator to control said link to actuate the steam valve to preclude flow of steam to said turbine.

3. A system according to claim 2 including coupling said shut-off valve to said supply of hydraulic fluid for maintaining said shut-off valve in said first position and against said bias.

4. A system according to claim 3 wherein the step of coupling said shut-off valve to said supply of hydraulic fluid includes providing a hydraulic line between said fluid supply and said shut-off valve, locating a solenoid actuated valve in said fluid supply line to interrupt the flow of fluid through said supply line in response to an electrical signal to enable the shut-off valve to be biased into said second position.

5. A control system for a steam turbine comprising:

a control link for controlling an actuator for a valve for supplying steam to the turbine;

a fluid actuated cylinder connected to said control link and biased for movement to a position wherein the control link controls the actuator to close the steam supply valve to the turbine;

a fluid supply for supplying fluid to said cylinder;

an electro-hydraulic servo control valve for controlling the supply of fluid to said cylinder;

a shut-off valve movable into first and second positions normally enabling fluid from said fluid supply flow through said servo control valve to said cylinder and preventing fluid from flowing from said fluid supply through said servo control valve to said cylinder, respectively; and means for normally maintaining said shut-off valve in said first position to enable said servo control valve to modulate the flow of fluid to said cylinder and responsive to a steam turbine system upset for preventing fluid from flowing to said cylinder whereby, said cylinder being biased into the position to close the steam supply valve.

* * * * *

UNITED STATES PATENT AND TRADEMARK OFFICE

CERTIFICATE OF CORRECTION

PATENT NO. : 5,346,360
DATED : September 13, 1994
INVENTOR(S) : Edward J. Cooper

It is certified that error appears in the above-identified patent and that said letters patent is hereby corrected as shown below:

Substitute the attached Figure 3 for original Figure 3.

Signed and Sealed this

Fourteenth Day of February, 1995

*Attest:*

*Attesting Officer*

BRUCE LEHMAN

*Commissioner of Patents and Trademarks*